US006001026A

United States Patent [19]

Breneman

[11] Patent Number: 6,001,026

[45] Date of Patent: Dec. 14, 1999

[54] GOLF TRAINING DEVICE

[76] Inventor: Fred E. Breneman, 1307 Parkland Ave., Carson City, Nev. 89701

[21] Appl. No.: 09/130,091

[22] Filed: Aug. 7, 1998

[51] Int. Cl.[6] ..... A63B 69/36

[52] U.S. Cl. ..... 473/261; 473/269; 473/278

[58] Field of Search ..... 473/278, 279, 473/261, 265, 269

[56] References Cited

U.S. PATENT DOCUMENTS

| | | | |
|---|---|---|---|
| 3,350,101 | 10/1967 | Bishop et al. | 473/265 |
| 3,639,923 | 2/1972 | Stewart | 473/269 |
| 4,088,325 | 5/1978 | Sutton | 473/269 |
| 4,346,896 | 8/1982 | Russell et al. | 473/279 |
| 5,383,665 | 1/1995 | Schultz et al. | 473/278 X |

*Primary Examiner*—George J. Marlo
*Attorney, Agent, or Firm*—Willie Krawitz

[57] ABSTRACT

A golf training device that includes a foldable rocker platform which is defined by a pair of half sections which when unfolded, define a circular platform on which a golfer stands to practice his or her back swing, down swing, stance, and the proper position when addressing the ball.

2 Claims, 2 Drawing Sheets

GOLF TRAINING DEVICE

BACKGROUND OF THE INVENTION:

The present invention comprises a golf training device, and more particularly a training device that comprises a foldable rocker platform defined by a pair of hinged half sections which when unfolded, provide a circular platform on which a golfer stands to practice his or her back swing, down swing, stance, and the proper position when addressing the ball.

It is well known to those who play golf that one must perfect a proper golf swing relative to the lie of the golf ball. In order to do so, however, it is essential that the golfer employ proper body balance throughout the entire swing to allow for a free flowing back swing which will flow smoothly into a coordinated down stroke along the line of flight that the ball must take after being hit by the golf club.

Accordingly, one must have proper body balance, which means the correct position of his or her body weight at various points along the swing. It has been well established that a golf swing should not comprise a series of individual or separate body movements on the part of the golfer, but preferably a single, continuous, smooth coordinated body motion made from a balanced position. This means the golfer must keep his or her body weight properly disposed throughout the entire stroke.

Various devices have been developed and used in helping a golfer to achieve a better swing, but most if not all have fallen into disuse because they do not give the player an immediate indication of whether he or she has properly and/or improperly controlled body movement relative to what is required for perfect contact with a golf ball, either at the tee or along the fairway.

Typical examples of publications in this field include U.S. Pat. Nos. 3,352,559; 3,633,918; 4,037,847; 4,088,325; 4,759,542; 5,333,876; 5,470,074; and, 5,527,042.

It is therefore an object of the present invention to provide a new and simple means for a golfer to train and to improve his or her swing, which includes perfecting a true back swing, a down swing, a proper stance, and for addressing the ball at various positions along the flight line.

Another object of the present invention is to provide more particularly a golf platform as a means to correct all the swing motions of the golfer, whereby in a relatively short period of time the golfer can learn to swing a golf club in a proper manner to establish a smooth, overall, continuous swing from the back swing to the down swing, so as to hit the ball harder, straighter and longer, whether it be off the tee or on the fairway.

It is another object of the invention to provide a device of this character that includes few operating parts, and that is foldable for ease of carrying and storing.

Still another object of the invention is to provide a golf platform training device that comprises a circular platform having a diameter of approximately three (3) feet, and that is formed having a pair of half sections that are semicircular and hingedly connected to one another to define the circular platform when the training device is unfolded for use.

Yet another object of the invention is to provide a golf platform training device that includes an axial pivot means which is established by a pair of semicircular aligned rocker bars, each being formed as part of the bottom structure of the respective semicircular half sections, whereby the platform is allowed to rock back and forth during the golfer's training swing. The arrangement of the rocker bars also allows the platform to rock from either side to side, or forwards and backwards, depending on the type of training needed by the golfer.

Figure 1:
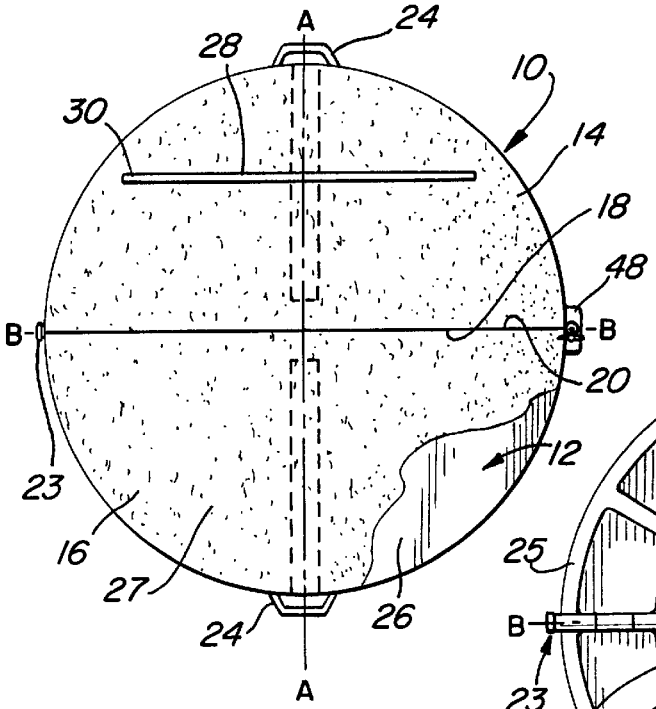
FIG. 1 is a top plan view of the golf training platform device shown in a fully open mode, and on which the golfer stands.
Figure 2:
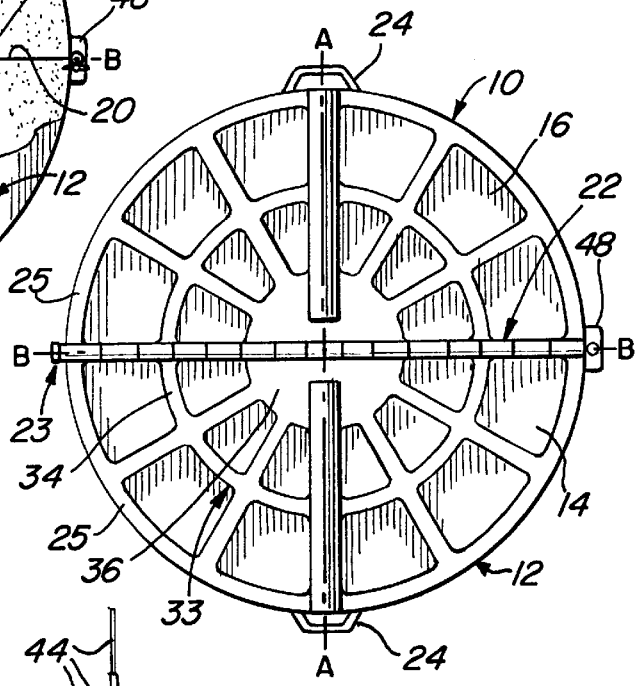
FIG. 2 is a bottom plan view thereof illustrating the location of the aligned semicircular rocker bars, and the position of the hinge that divides the respective semicircular half sections of the platform.
Figure 3:
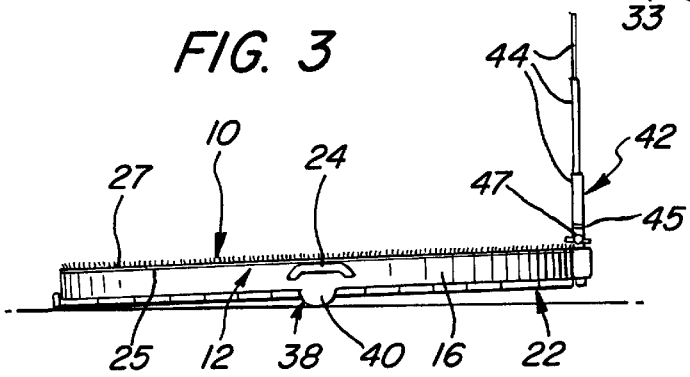
FIG. 3 is a front elevation view of the device as illustrated in FIG. 1.

DESCRIPTION OF THE PREFERRED EMBODIMENTS:

The preferred embodiment of the present invention which defines a golf training platform device 10, is generally indicated and illustrated in FIGS. 1, 2 and 3, wherein the golf training platform comprises a circular platform 12, formed by a pair of semicircular half sections 14 and 16. When both half sections are folded outwardly, an approximate three (3) foot diameter platform 12 is defined.

Figure 5:
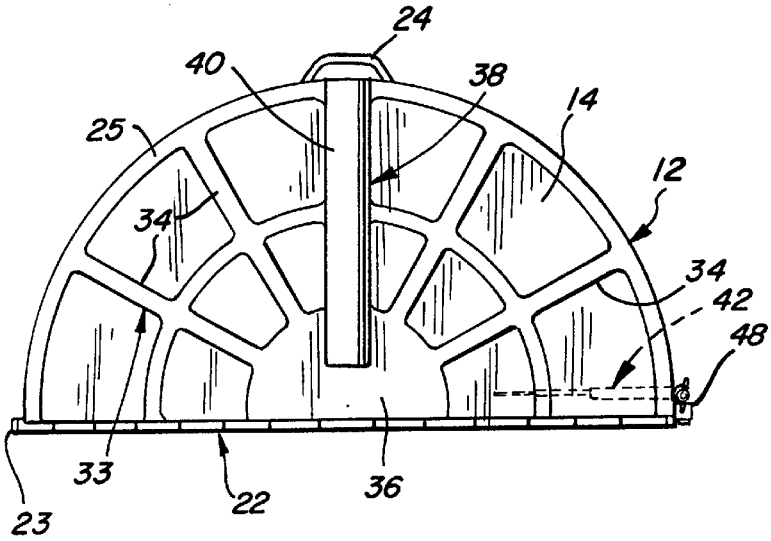
FIG. 5 is an elevation view of one of the half sections when the platform is in a folded position.
Figure 6:
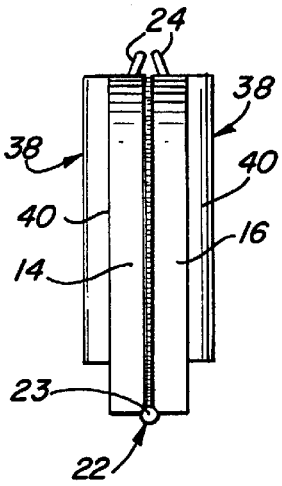
FIG. 6 is an end view of the present invention in a collapsed folded arrangement; and, FIG. 7 is a pictorial view of the golfer in a proper position for addressing the ball prior to swinging the club; and, FIG. 8 is a pictorial view of the golfer completing a back swing.

The two semicircular half sections 14, 16 are hingedly connected along their respective straight edges 18 and 20 by mean of a lock-type hinge 22. This enables the two half sections 14, 16 to be locked in a substantially flat arrangement as illustrated in FIGS. 5 and 6 by a locking means 23 located at one end of the hinge. Thus, hinge means 22 can be formed in any suitable manner that allows the circular platform to be folded and locked, whereby the golf training platform device 10 can be readily carried by means of a pair of handles 24 which are attached along the oppositely disposed annular free edges of each wall structure 25, and which also allows the folded platform to be easily stored.

Figure 7:
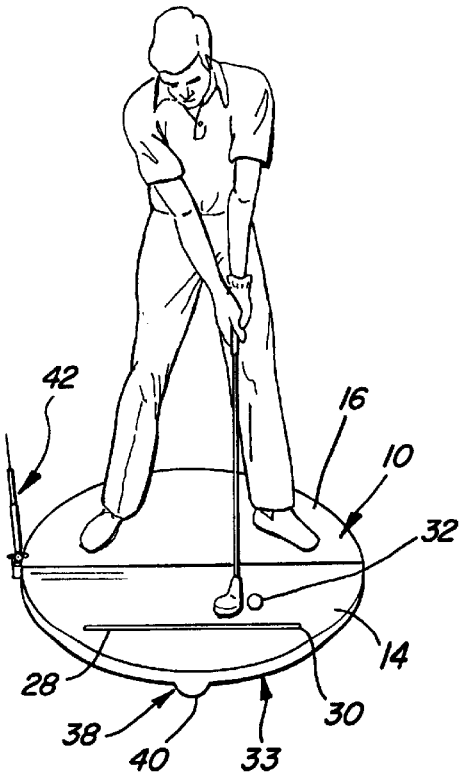

Preferably, the two half sections 14 and 16 are each formed from a suitable plastic material or a suitable light-weight metal alloy, with each having a flat, planar surface 26 covered by a grass turf-like material 27 that can be made of any suitable color, similar to natural grass. A guide line indicator 28 is marked on the turf so as to provide a straight line 30 which defines the flight direction of a golf ball 32, and which also provides a means to better gauge the golfer's stance when addressing the golf ball, as illustrated in FIG. 7.

The bottom wall structure 33 of each half section 14 and 16, is illustrated in FIGS. 2 and 5, and defines a plurality of rib members 34 that extend radially inwardly from the outer wall member 25 to a central support member 36, thereby providing a reinforced, integral platform where the golfer stands during use.

A centrally located pivot means 38 is formed integrally with the bottom wall structure 33 and comprises a pair of pivot bar members 40 which are aligned with each other and positioned longitudinally along the central axis A—A of the platform 12. The pivot means 38 is positioned transversely to the central axis B—B of the hinge means 22 along the central portion thereof, and is illustrated in FIGS. 1 and 2. The pivot bar members 40 are also formed with a semicircular configuration having a thickness that extends below bottom wall structure 33 when the platform is arranged in an operational mode, as shown in FIG. 3. Hence, the platform is allowed to rock back and forth by means of the pivot bar members 40 when the golfers practice their swing to improve or correct their stance and body movement during their back swing and down swing.

Figure 4:
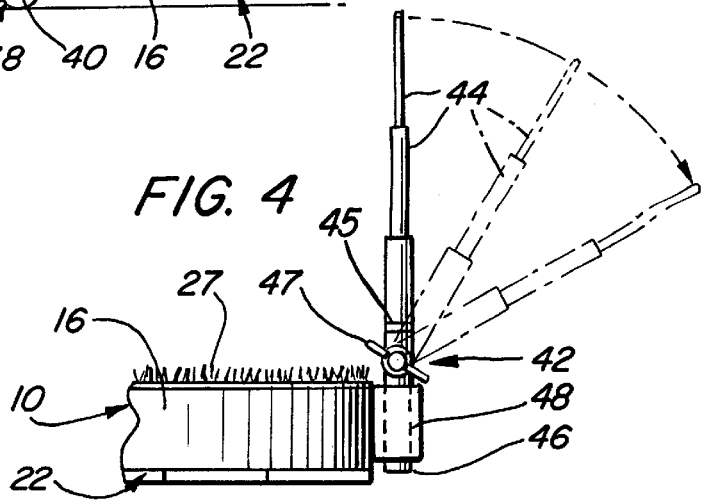
FIG. 4 is an enlarged view of the telescoping swing guide assembly.
Figure 8:
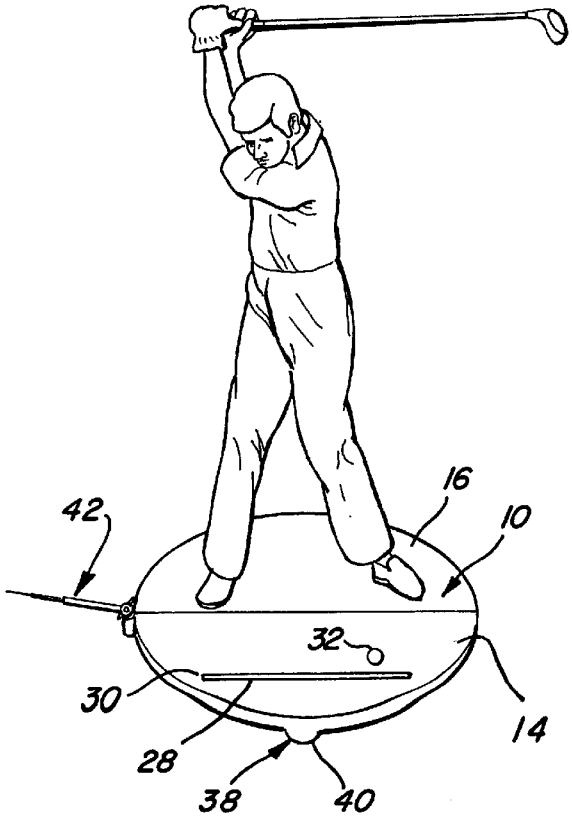

FIG. 4 shows a telescoping swing guide assembly 42, which comprises a flexible telescoping guide that includes two or more telescoping rod members 44 mounted to a pivot support member 46 and providing a means 47 for selectively setting the position of the telescoping swing guide. The pivot support member 46 is removably mounted in a mounting bracket 48 that is attached to one of the half sections in alignment with axis B—B, as shown in FIGS. 1, 7 and 8. The telescoping swing guide 42 is used to aid golfers in perfecting mainly their back swing, or down swing. Accordingly, the telescoping swing guide assembly 42 is adjustable in various directions or positions as desired by a golfer. Also, a club contact indicator 45 may be employed to provide a sound or a light when the club contacts the telescoping swing guide assembly.

I claim:

1. A golf training device, comprising:

a.) a circular golf training platform defined by a pair of foldable half sections hingedly connected to each other to define the training platform when the foldable half sections are extended to define a flat plane on which a golfer stands;

b.) hinge means hingedly connecting said half sections together;

c.) a hinge locking means, whereby the golf training device can be locked in a closed, inactive mode;

d.) pivot means formed integrally with the bottom of the golf training platform and extending downwardly therefrom when the platform is arranged in an operational mode, the pivot means allowing a golfer to rock the platform back and forth when the golfer practices a swing, thereby enabling a correction or improvement in body stance and body movement during a back and down swing.

2. A golf training device, comprising:

a.) a circular golf training platform defined by a pair of foldable half sections hingedly connected to each other to define the training platform when the foldable half sections are extended to define a flat plane on which a golfer stands;

b.) hinge means hingedly connecting said half sections together;

c.) a hinge locking means, whereby the golf training device can be locked in a closed, inactive mode;

d.) pivot means formed integrally with the bottom of the golf training platform and extending downwardly therefrom when the platform is arranged in an operational mode, the pivot means allowing a golfer to rock the platform back and forth when the golfer practices a swing, thereby enabling a correction or improvement in body stance and body movement during a back and down swing; and, e.) a telescoping swing guide assembly adjustably mounted to one of said half sections.

* * * * *